US006769385B1

(12) United States Patent
Chang

(10) Patent No.: US 6,769,385 B1
(45) Date of Patent: Aug. 3, 2004

(54) SYSTEM FOR CONTROLLING ENGINE VALVE SEATING VELOCITY

(75) Inventor: David Y. Chang, Savoy, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/385,503

(22) Filed: Mar. 12, 2003

(51) Int. Cl.[7] ..... F01L 1/34

(52) U.S. Cl. ..... 123/90.16; 123/90.12; 123/90.49; 123/90.55; 123/90.57

(58) Field of Search ..... 123/90.16, 90.12, 123/90.15, 90.49, 90.55, 90.57, 188.8; 91/407–409

(56) References Cited

U.S. PATENT DOCUMENTS 4,343,228 A * 8/1982 Wallis ..... 91/457
5,577,468 A * 11/1996 Weber ..... 123/90.12
6,067,946 A * 5/2000 Bunker et al. ..... 12/90.12
6,192,841 B1 2/2001 Vorih et al. ..... 123/90.12
6,237,551 B1 5/2001 Macor et al. ..... 123/90.15
6,412,457 B1 * 7/2002 Vorih et al. ..... 123/90.12
6,474,277 B1 * 11/2002 Vanderpoel et al. ..... 123/90.12
6,550,433 B2 * 4/2003 Vorih et al. ..... 123/90.15

* cited by examiner

*Primary Examiner*—Thomas Denion
*Assistant Examiner*—Kyle Riddle
(74) *Attorney, Agent, or Firm*—Finnegan, Henderson, Farabow, Garrett & Dunner

(57) ABSTRACT

A velocity control system for an engine valve is provided. The system includes a valve having a housing defining an opening, a chamber adapted to receive a fluid, a first fluid passageway connecting the opening with the chamber, a second fluid passageway connecting the opening with the chamber, and a third fluid passageway connecting the opening with the chamber. A piston is slidably disposed in the chamber and is moveable from a first position to a second position. The movement of the piston from the first position to the second position forces fluid from the chamber at a first flow rate during movement of the piston through a first travel distance and at a second flow rate during movement of the piston through a second travel distance. The first flow rate is greater than the second flow rate. A check valve is adapted to prevent fluid from flowing from the chamber through the first fluid passageway when the piston is moving from the first position to the second position.

22 Claims, 4 Drawing Sheets

SYSTEM FOR CONTROLLING ENGINE VALVE SEATING VELOCITY

TECHNICAL FIELD

The present invention is directed to a system for controlling the seating velocity of an engine valve and, more particularly, to a system for controlling the seating velocity of an engine valve in a variable valve actuation system.

BACKGROUND

Internal combustion engines typically include a series of valves that control a flow of gases into and out of the engine. An engine may include a series of intake valves that control the flow of gases into a series of combustion chambers. The engine may also include a series of exhaust valves that control the flow of gases from the combustion chambers.

An internal combustion engine may also include a cam assembly that controls the actuation timing of the engine valves. A cam assembly typically includes a series of cams that are rotated in coordination with a crankshaft of the engine to cause the intake and exhaust valves to open at certain points in the operating cycle of the engine. For example, the intake valves associated with a combustion chamber may be opened when the piston disposed in the chamber moves through an intake stroke and the exhaust valves associated with the combustion chamber may be opened when the piston moves through an exhaust stroke.

A valve return spring acts on each engine valve to maintain a connection between the engine valve and the rotating cams. Each valve return spring typically exerts a significant force on the engine valve to ensure that the connection with the particular cam is not lost. The force of each valve return spring also acts to close each engine valve when the shape of the particular cam allows.

One approach to improving the overall efficiency of an internal combustion engine involves adjusting the actuation timing of the engine valves when the engine is experiencing a certain set of operating conditions. For example, the actuation timing of the intake and/or exhaust valves may be modified to implement a variation on the typical diesel or Otto cycle known as the Miller cycle. In a "late intake" type Miller cycle, the intake valves of the engine are held open during a portion of the compression stroke of the piston. Selective implementation of a timing variation, such as the late-intake Miller cycle, may lead to an improvement in the overall efficiency of the engine.

However, to vary the actuation timing of an engine valve, the engine valve must be selectively disconnected from the associated cam. This may be accomplished, for example, by a hydraulic actuator or another device that forms a controllable link between the cam and the engine valve. For example, as described in U.S. Pat. No. 6,237,551 to Macor et al., issued on May 29, 2001, an engine valve actuation system may include a hydraulic actuator that establishes a hydraulic link between the cam and an intake valve. When the link is established, the valve will be actuated according to the shape of the cam. However, when the hydraulic link is broken, such as by opening a control valve to release fluid trapped between the intake valve and the cam assembly, the force of a valve return spring causes the engine valve to close. Thus, breaking the hydraulic link allows the engine valve to close at an earlier timing than would be achieved by the shape of the cam.

When the link between the cam and the engine valve is broken, the return spring acts on the valve to close the valve.

As the cam assembly is not opposing the force of the valve return spring, the engine valve may close with a substantial force. The impact generated upon the closing of the engine valve may result in damage to the sealing elements of the engine valve. Any of this type of damage to the engine valve may prevent the valve element from properly sealing the combustion chamber. This may negatively impact the efficiency of the engine and result in a need for increased maintenance.

The disclosed system solves one or more of the problems set forth above.

SUMMARY OF THE INVENTION

In one aspect, the present invention is directed to a velocity control system that includes a housing defining an opening, a chamber adapted to receive a fluid, a first fluid passageway connecting the opening with the chamber, a second fluid passageway connecting the opening with the chamber, and a third fluid passageway connecting the opening with the chamber. A piston is slidably disposed in the chamber and is moveable from a first position to a second position. The movement of the piston from the first position to the second position forces fluid from the chamber at a first flow rate during movement of the piston through a first travel distance and at a second flow rate during movement of the piston through a second travel distance. The first flow rate is greater than the second flow rate. A check valve is adapted to prevent fluid from flowing from the chamber through the first fluid passageway when the piston is moving from the first position to the second position.

In another aspect, the present invention is directed to a method of controlling the velocity of an engine valve. A cam assembly is operated to move an engine valve between a first position where the engine valve prevents a flow of fluid and a second position where the engine valve allows a flow of fluid. A piston is moved from a first position to a second position to operatively engage an end of the piston with the engine valve to prevent the engine valve from returning to the first position. The piston is slidably disposed in a chamber of a housing. Fluid is provided to the chamber through a first fluid passageway, a second fluid passageway, and a third fluid passageway in the housing during movement of the piston from the first position to the second position. Fluid is released from the chamber at a first flow rate during movement of the piston through a first travel distance from the second position to the first position. Fluid is released from the chamber at a second flow rate during movement of the piston through a second travel distance from the second position to the first position. The second flow rate is less than the first flow rate.

DETAILED DESCRIPTION

Figure 1:
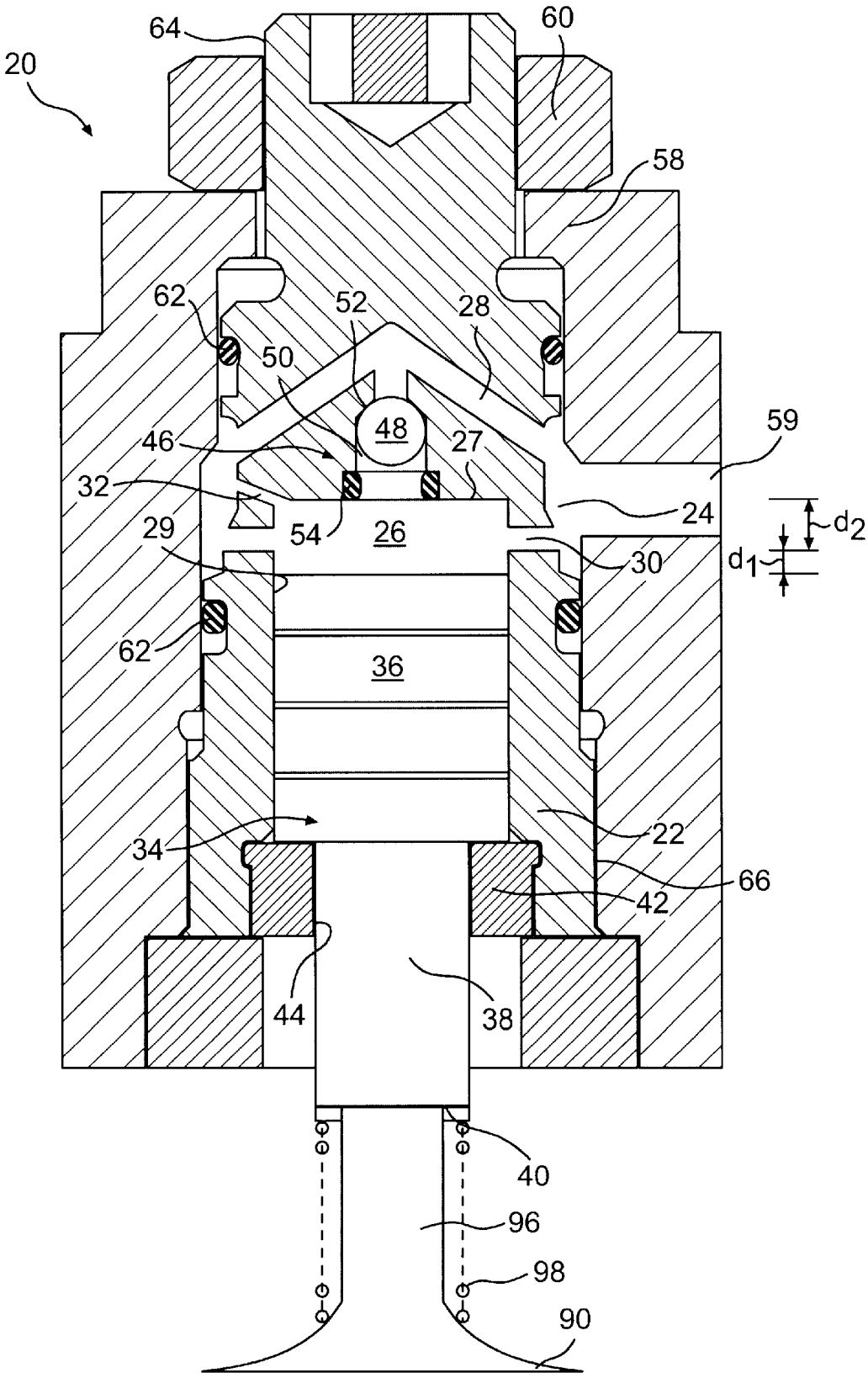
FIG. 1 is a cross-sectional view of a system in accordance with an exemplary embodiment of the present invention, illustrating a piston in a first position.

An exemplary embodiment of a system for controlling the seating velocity of an engine valve is illustrated in FIGS. 1 and 2. As shown, the system includes a valve 20 that has a housing 22. Housing 22 includes a chamber 26, an opening 24, and a series of fluid passageways that connect opening 24 with chamber 26. For example, housing 22 may include a first fluid passageway 28, a second fluid passageway 30, and a third fluid passageway 32. Each of first, second, and third fluid passageways 28, 30, and 32 provide a fluid connection between opening 24 and chamber 26.

A piston 34 may be disposed in chamber 26. Piston 34 may include a body 36 and a rod 38 having an end 40. One or more seals (not shown) may be disposed between piston body 36 and a sidewall 29 of chamber 26 to prevent fluid from leaking from chamber 26.

Piston 34 may be slidably disposed in chamber 26. Piston 34 may be moved between a first position and a second position. As illustrated in FIG. 1, when piston 34 is in the first position, end 40 of piston rod 38 is extended relative to housing 22. A stop plate 42 may be engaged with housing 22 to define the first position of piston 34. Stop plate 42 may include an opening 44 that is adapted to receive rod 38 of piston 34. The extension of rod 38 relative to housing 22 may be limited by engagement of body 36 with stop plate 42.

Figure 2:
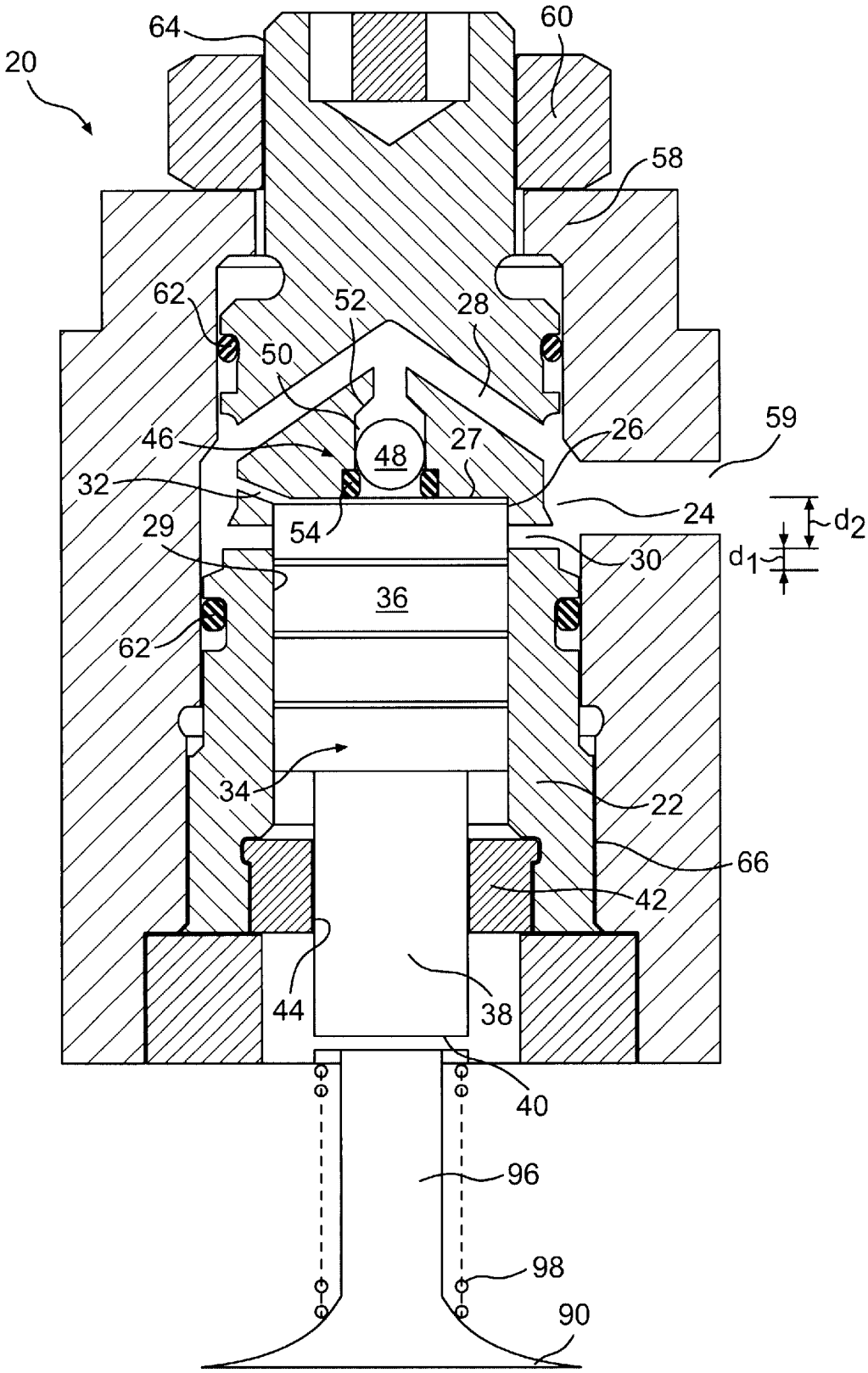
FIG. 2 is a cross-sectional view of a system in accordance with an exemplary embodiment of the present invention, illustrating a piston in a second position.

As shown in FIG. 2, when piston is in the second position, end 40 of piston rod 38 is withdrawn relative to housing 22. A wall 27 of chamber 26 may define the second position of piston 34. Piston 34 may withdraw rod 38 relative to housing 22 until body 36 of piston 34 engages a wall 27 of chamber 26.

Both first fluid passageway 28 and third fluid passageway 32 open to chamber 26 through wall 27. Second fluid passageway 30 opens to chamber 26 through sidewall 29 of chamber 26. Accordingly, as piston 34 moves towards the second position, piston body 36 will block second fluid passageway 30 to prevent fluid from flowing through second fluid passageway 30. Thus, second fluid passageway 30 will be open for a first travel distance (indicated by $d_1$ in FIGS. 1 and 2) and blocked or partially blocked for a second travel distance (indicated by $d_2$ in FIGS. 1 and 2) of piston 34.

A flow control means may be disposed in first passageway 28. Flow control means may be any valve or device adapted to allow a one-way flow of fluid. For example, the flow control means may allow fluid to flow through first fluid passageway 28 into chamber 26, but prevent fluid from flowing from chamber 26 through first fluid passageway 28.

The flow control means may be, for example, a ball-type check valve 46. Check valve 46 may include a ball 48 that is disposed in a chamber 50. Check valve 46 may also include a first seat 52 and a second seat 54.

Figure 3:
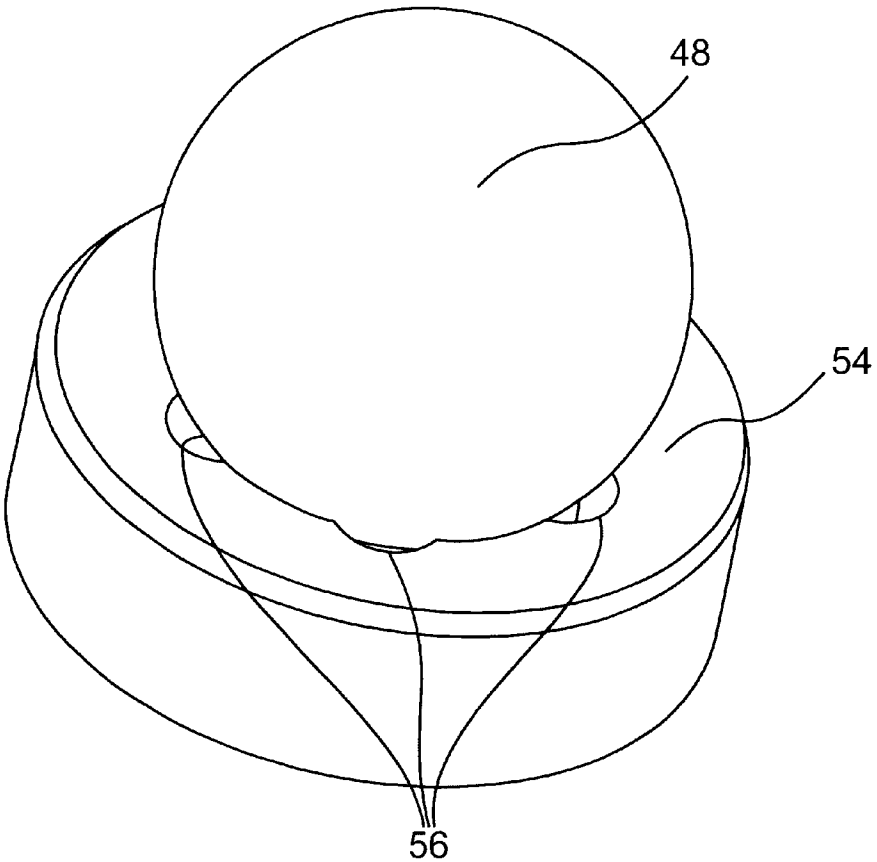
FIG. 3 is a pictorial representation of a check valve in accordance with an exemplary embodiment of the present invention.

Ball 48 may be engageable with first seat 52 (as shown in FIG. 1) and second seat 54 (as shown in FIG. 2). First seat 52 is adapted to prevent fluid from flowing through check valve 46 when ball 48 is engaged with first seat 52. As shown in FIG. 3, second seat 54 includes a series of passageways 56. Passageways 56 are adapted to allow fluid to flow through second seat 54 and/or between ball 48 and second seat 54 when ball 48 is engaged with second seat 54.

Housing 22 may be disposed within a body 58 having a fluid passageway 59. Housing 22 may have external threads 64 and 66. Threads 66 may engage corresponding threads in body 58 to position housing 22 with respect to body 58. When housing 22 is positioned such that opening 24 is aligned with passageway 59, a nut 60 may be engaged with threads 64 to secure housing 22 relative to body 58. In addition, a pair of seals 62 may be disposed between housing 22 and body 58 on either side of opening 24 to prevent fluid from leaking between housing 22 and body 58.

Figure 4:
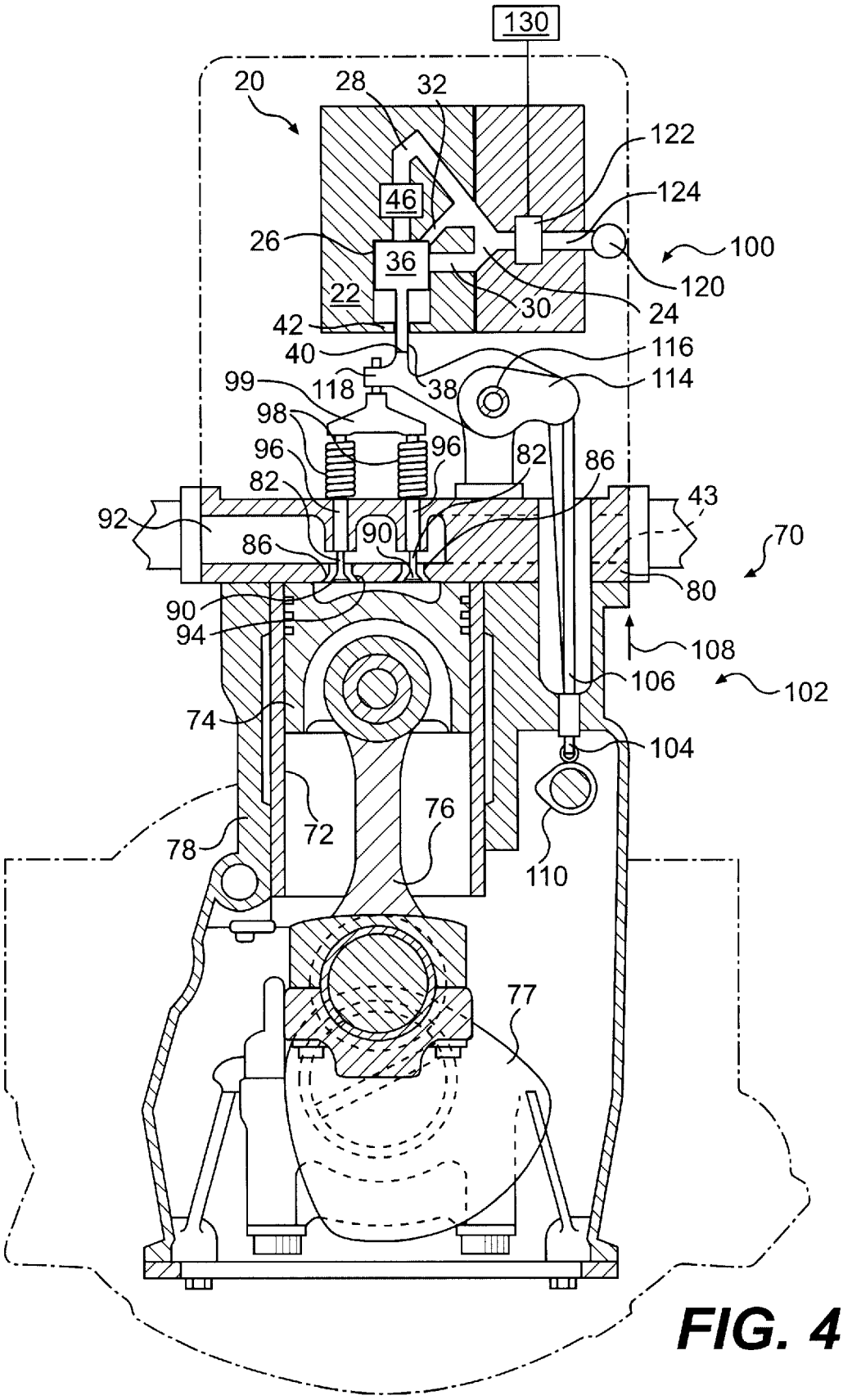
FIG. 4 is a diagrammatic cross-sectional view of a cylinder and valve actuation assembly in accordance with an exemplary embodiment of the present invention.

As illustrated in FIG. 4, valve 20 may be included as part of a valve actuation assembly 100 for an internal combustion engine 70. For the purposes of the present disclosure, engine 70 is depicted and described as a four stroke diesel engine. One skilled in the art will recognize, however, that engine 70 may be any other type of internal combustion engine, such as, for example, a gasoline or natural gas engine.

Engine 70 includes an engine block 78 that defines a plurality of cylinders 72 (one of which is illustrated in FIG. 4). A piston 74 is slidably disposed within each cylinder 72. Engine 70 may include six cylinders 72 and six associated pistons 74. One skilled in the art will readily recognize that engine 70 may include a greater or lesser number of pistons 74 and that pistons 74 may be disposed in an "in-line" configuration, a "V" configuration, or any other conventional configuration.

As also shown in FIG. 4, engine 70 includes a crankshaft 77 that is rotatably disposed within engine block 78. A connecting rod 76 connects each piston 74 to crankshaft 77. Each piston 74 is coupled to crankshaft 77 so that a sliding motion of piston 74 within the respective cylinder 72 results in a rotation of crankshaft 77. Similarly, a rotation of crankshaft 77 will result in a sliding motion of piston 74.

Each piston 74 may be adapted to reciprocate between a top-dead-center position and a bottom-dead-center position. During conventional four-stroke diesel operation of engine 70, each piston 74 will reciprocate between the top-dead-center position and the bottom-dead-center position through an intake stroke, a compression stroke, a combustion stroke, and an exhaust stroke. One skilled in the art will recognize that pistons 74 may also be utilized to implement another type of engine combustion cycle.

Engine 70 also includes a cylinder head 80. Cylinder head 80 defines a passageway 92 that leads to at least one port 86 for each cylinder 72. Each port 86 includes a seat 94. Passageway 92 may either be an intake passageway that directs intake air to cylinder 72 or an exhaust passageway that conducts combustion gases from cylinder 72.

An engine valve 82 may be disposed within each port 86. Engine valve 82 may be either an intake valve associated with an intake passageway or an exhaust valve associated with an exhaust passageway. Engine valve 82 includes a valve stem 96 and a valve element 90. Valve element 90 is adapted to selectively engage seat 94.

Each engine valve 82 may be moved between a first position, where engine valve 82 is closed to prevent a flow of fluid relative to cylinder 72, and a second position, where engine valve 82 is opened to allow a flow of fluid relative to cylinder 72. In the first position, valve element 90 of engine valve 82 engages valve seat 94 to thereby prevent fluid flow relative to engine valve 82. In the second position, valve element 90 of engine valve 82 is lifted from seat 94 to thereby allow a flow of fluid relative to engine valve 82.

Valve actuation assembly 100 is operatively associated with engine valves 82. Valve actuation assembly 100 includes a bridge 99 that is connected to each valve element 90 through valve stems 96. A valve return spring 98 may be disposed around each valve stem 96 between cylinder head 80 and bridge 99. Valve return spring 98 acts to bias both valve elements 90 into engagement with the respective seat 94 to thereby close each port 86.

Valve actuation assembly 100 also includes a rocker arm 114. Rocker arm 114 is configured to pivot about a pivot 116. One end 118 of rocker arm 114 is connected to bridge 99. The opposite end of rocker arm 114 is connected to a cam assembly 102. Cam assembly 102 may include a cam 110 having a cam lobe and being mounted on a cam shaft, a push rod 106, and a cam follower 104. One skilled in the art will recognize that cam assembly 102 may have other configurations, such as, for example, where cam 110 acts directly on rocker arm 114.

Valve actuation assembly 100 may be driven by cam 110. Cam 110 is connected to crankshaft 77 so that a rotation of crankshaft 77 induces a corresponding rotation of cam 110. Cam 110 may be connected to crankshaft 77 through any means readily apparent to one skilled in the art, such as, for example, through a gear reduction assembly (not shown). As one skilled in the art will recognize, a rotation of cam 110 will cause cam follower 104 and associated push rod 106 to periodically reciprocate between an upper and a lower position.

The reciprocating movement of push rod 106 causes rocker arm 114 to pivot about pivot 116. When push rod 106 moves in the direction indicated by arrow 108, rocker arm 114 will pivot and move bridge 99 in the opposite direction. The movement of bridge 99 causes engine valves 82 to lift and open ports 86. As cam 110 continues to rotate, valve return springs 98 will act on bridge 99 to return engine valves 82 to the closed position.

In this manner, the shape and orientation of cam 110 controls the timing of the actuation of engine valves 82. As one skilled in the art will recognize, cam 110 may be configured to coordinate the actuation of engine valves 82 with the movement of piston 74. For example, engine valves 82 may be actuated to open ports 86 when piston 74 is moving through an intake stroke to allow air to flow from passageway 92 into cylinder 72.

Valve 20 may be disposed to position end 40 of piston 34 adjacent end 118 of rocker arm 114. A fluid source 120 may be connected to opening 24 through a fluid passageway 124. Fluid source 120 may be part of a lubrication system, such as typically accompanies an internal combustion engine. Fluid source 120 provides pressurized fluid to opening 24 of housing 22. For example, fluid source 120 may provide fluid having a pressure of less than 700 KPa (100 psi) or, more particularly, between about 210 KPa and 620 KPa (30 psi and 90 psi).

A control valve 122 may be disposed in passageway 124 to control the flow of fluid to and from valve 20 through passageway 124. For example, control valve 122 may be opened to allow fluid to flow through passageway 124. Control valve 122 may be closed to prevent fluid from flowing through passageway 124.

Control valve 122 may be normally biased into a closed position and actuated to allow fluid to flow through control valve 122. Alternatively, control valve 122 may be normally biased into an open position and actuated to prevent fluid from flowing through control valve 122. One skilled in the art will recognize that control valve 122 may be any type of controllable valve, such as, for example a two coil latching valve.

A controller 130 may be connected to control valve 122 of each valve actuation assembly 100. Controller 130 may include an electronic control module that has a microprocessor and a memory. As is known to those skilled in the art, the memory is connected to the microprocessor and stores an instruction set and variables. Associated with the microprocessor and part of electronic control module are various other known circuits such as, for example, power supply circuitry, signal conditioning circuitry, and solenoid driver circuitry, among others.

Controller 130 may be programmed to control one or more aspects of the operation of engine 70. For example, controller 130 may be programmed to control the valve actuation assembly 100, the fuel injection system, and any other function readily apparent to one skilled in the art. Controller 130 may control engine 70 based on the current operating conditions of the engine and/or instructions received from an operator.

Controller 130 may be further programmed to receive information from one or more sensors operatively connected with engine 70. Each of the sensors may be configured to sense one or more operational parameters of engine 70. One skilled in the art will recognize that many types of sensors may be used in conjunction with engine 70. For example, engine 70 may be equipped with sensors configured to sense one or more of the following: the temperature of the engine coolant, the temperature of the engine, the ambient air temperature, the engine speed, the load on the engine, and the intake air pressure.

Engine 70 may be further equipped with a sensor configured to monitor the crank angle of crankshaft 77 to thereby determine the position of pistons 24 within their respective cylinders 72. The crank angle of crankshaft 77 is also related to actuation timing of engine valves 82.

Industrial Applicability

Controller 130 may control the position of control valve 122 to modify the actuation timing of engine valves 82. For example, controller 130 may move control valve 122 to implement a late-intake type Miller cycle. The following discussion describes the implementation of a late-intake Miller cycle in a single cylinder 72 of engine 70. One skilled in the art will recognize that the disclosed system may be used to selectively implement a late-intake Miller cycle in all cylinders of engine 70 in the same or a similar manner. In addition, the disclosed system may be used to implement other valve actuation variations on the conventional diesel cycle, such as, for example, an exhaust Miller cycle.

A late-intake Miller cycle may be implemented by holding the intake valves 82 open for a first portion of the compression stroke of piston 74. This may be accomplished by opening control valve 122 when piston 74 moves from the top-dead-center position at the beginning of an intake stroke. This allows pressurized fluid to flow from source of fluid 120 through passageway 124 to opening 24 in valve housing 22.

When piston 34 is in the second position (as shown in FIG. 2), piston body 36 blocks second fluid passageway 30. Accordingly, the pressurized fluid in opening 24 may flow through first fluid passageway 28 to move ball 48 of check valve 46 into engagement with second seat 54. When ball 48 is engaged with second seat 54, fluid is allowed to flow through check valve 46 and into chamber 26. In addition, fluid may flow through third fluid passageway 32 to chamber 26.

The pressurized fluid entering chamber 26 acts to move piston 34 towards the first position and thereby extend rod 38 relative to housing 22. The movement of piston 34 from the second position will eventually open second fluid passageway 30. At this point fluid may also flow through second fluid passageway into chamber 26. Fluid will continue to fill chamber 26 until piston 34 moves to the first position where body 36 engages stop plate 42 and rod 38 is fully extended with respect to housing 22.

When piston 34 is in the first position, controller 130 may close control valve 122. This prevents fluid from escaping from chamber 26. As cam 110 continues to rotate and valve return springs 98 urge engine valves 82 towards the closed position, end 40 of piston rod 38 will engage end 118 of rocker arm 114 and prevent engine valves 82 from closing. As long as control valve 122 remains in the closed position, the fluid trapped in chamber 26 will prevent valve return spring 98 from returning engine valves 82 to the closed position. In this manner, the actuation of engine valves 82 may be delayed to thereby implement a variation on conventional valve actuation timing, such as the late-intake Miller cycle.

Controller 130 may close engine valves 82 by opening control valve 122 to allow fluid to escape chamber 26. The force of valve return springs 98 forces the fluid from chamber 26, thereby allowing piston 34 to move within housing 22. This allows rocker arm 114 to pivot so that engine valves 82 move to the closed position.

Valve 20 controls the velocity at which engine valve 82 returns to the closed position. For a first travel distance, fluid exits chamber 26 through second and third fluid passageways 30 and 32. As noted previously, ball 48 of check valve 46 engages first seat 52 to prevent fluid from flowing through first fluid passageway 28. Accordingly, the velocity of piston 34 relative to chamber 26 and, thus, the closing velocity of engine valve 82 is dependent upon the rate at which fluid exits chamber 26 through second and third fluid passageways 30 and 32. A greater flow rate through second and third fluid passageways 30 and 32 will result in a greater velocity of piston 34 than a lesser flow rate through second and third fluid passageways 30 and 32.

After piston 34 moves through the first travel distance, body 36 of piston 34 will begin to restrict fluid flow through second fluid passageway 30. Accordingly, the velocity of piston 34 will decrease. Once piston body 36 covers the opening of second fluid passageway 30, the velocity of piston will be dependent upon the rate at which fluid flows through third fluid passageway 32. Thus, the velocity of piston 34 moving through the second travel distance, will be less than the velocity of piston 34 moving through the first travel distance.

The size of third fluid passageways 32 and the location of the opening in sidewall 29 may be determined to ensure that the velocity of piston is reduced such that engine valve 82 will return to the closed position at a reduced speed. In one exemplary embodiment, third fluid passageway 30 is sized to allow a smaller fluid flow rate than second fluid passageway 28. The resulting decrease in fluid flow rate and associated reduction in the velocity of engine valve 82 will reduce the impact generated when valve element 90 engages seat 94. In this manner, valve 20 may prevent damage to engine valve 82.

As will be apparent from the foregoing description, the described system may be used to control the seating velocity of an engine valve. The system may be used, for example, to prevent damage to engine valves in a variable valve actuation system. One skilled in the art will recognize that the described valve may be used in any application where a variable velocity valve is required. One skilled in the art will also recognize that the described valve may provide for convenient assembly and a low manufacturing cost.

It will be apparent to those skilled in the art that various modifications and variations can be made in the described system without departing from the scope of the invention. Other embodiments of the valve will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A velocity control system, comprising:

a housing defining an opening, a chamber adapted to receive a fluid, a first fluid passageway connecting the opening with the chamber, a second fluid passageway connecting the opening with the chamber, and a third fluid passageway connecting the opening with the chamber;

a piston slidably disposed in the chamber and moveable from a first piston position to a second piston position, the movement of the piston from the first piston position to the second piston position forcing fluid from the chamber at a first flow rate during movement of the piston through a first travel distance and at a second flow rate during movement of the piston through a second travel distance, wherein the first flow rate is greater than the second flow rate;

a check valve adapted to prevent fluid from flowing from the chamber through the first fluid passageway when the piston is moving from the first piston position to the second piston position; and a control valve in fluid communication with the opening and having a first position where fluid is allowed to flow from the chamber and a second position where fluid is selectively blocked from flowing from the chamber.

2. The system of claim 1, wherein the piston blocks the second fluid passageway after the piston moves through the first travel distance to thereby prevent fluid from flowing from the chamber through the second fluid passageway.

3. The system of claim 1, wherein the second fluid passageway is configured to allow a greater flow of fluid than the third fluid passageway.

4. The system of claim 1, wherein the check valve includes a ball operatively engageable with a first seat and a second seat and wherein engagement of the ball with the first seat prevents a flow of fluid through the first fluid passageway.

5. The system of claim 4, wherein the ball engages the first seat when the piston is moving from the first piston position to the second piston position.

6. The system of claim 4, wherein the second seat of the check valve has at least one passageway adapted to allow fluid to flow from the first fluid passageway to the chamber when the ball is engaged with the second seat.

7. The system of claim 1, wherein fluid flows from the opening to the chamber through each of the first, second, and third fluid passageways when the piston moves from the second piston position towards the first piston position.

8. The velocity control system of claim 1, wherein the flow of fluid from the chamber is selectively blocked to stop movement of the piston at a position between the first piston position and the second piston position.

9. A velocity control system, comprising:

a housing defining an opening, a chamber adapted to receive a fluid, a first fluid passageway connecting the opening with the chamber, a second fluid passageway connecting the opening with the chamber, and a third fluid passageway connecting the opening with the chamber;

a piston slidably disposed in the chamber and moveable from a first position to a second position;

a first valve means for releasing fluid from the chamber at a first flow rate during movement of the piston through a first travel distance between the first position and the second position and for releasing fluid from the chamber at a second flow rate during movement of the piston through a second travel distance between the first position and the second position;

a second valve means for preventing fluid from flowing from the chamber through the first fluid passageway when the piston is moving from the first position to the second position; and a third valve means for selectively preventing fluid from flowing from the chamber through the opening.

10. The system of claim 9, wherein the second valve means includes a check valve.

11. The system of claim 10, wherein the check valve includes a ball operatively engageable with a first seat to prevent a flow of fluid through the first fluid passageway and a second seat having at least one passageway adapted to allow fluid to flow from the first fluid passageway to the chamber when the ball is engaged with the second seat.

12. The velocity control system of claim 9, wherein the flow of fluid from the chamber is selectively blocked to stop movement of the piston at a position between the first position and the second position.

13. A method of controlling the velocity of an engine valve, comprising:

operating a cam assembly to move an engine valve between a first position where the engine valve prevents a flow of fluid and a second position where the engine valve allows a flow of fluid;

moving a piston from a first position to a second position to operatively engage an end of the piston with the engine valve to prevent the engine valve from returning to the first position, this piston being slidably disposed in a chamber of a housing;

providing fluid to the chamber through a first fluid passageway, a second fluid passageway, and a third fluid passageway in the housing during movement of the piston from the first position to the second position;

releasing fluid from the chamber at a first flow rate during movement of the piston through a first travel distance from the second position to the first position; and releasing fluid from the chamber at a second flow rate during movement of the piston through a second travel distance from the second position to the first position, and second flow rate being less than the first flow rate.

14. The method of claim 13, wherein fluid is released through the second and third fluid passageways during movement of the piston through the first travel distance.

15. The method of claim 14, wherein second fluid passageway is blocked and fluid is released through the third fluid passageway during movement of the piston through the second travel distance.

16. The method of claim 13, further including preventing fluid from flowing through the first fluid passageway when the piston moves from the second position to the first position.

17. An engine valve actuation system, comprising:

an engine valve moveable between a first position to prevent a flow of fluid and a second position to allow a flow of fluid;

a cam assembly connected to move the engine valve between the first position and the second position;

a housing defining an opening, a chamber adapted to receive a fluid, a first fluid passageway connecting the opening with the chamber, a second fluid passageway connecting the opening with the chamber, and a third fluid passageway connecting the opening with the chamber;

a piston having an end and being slidably disposed in the chamber for movement between a first position where the end is operatively engageable with the engine valve and a second position, the movement of the piston from the first position to the second position forcing fluid from the chamber at a first flow rate during movement of the piston through a first travel distance and at a second flow rate during movement of the piston through a second travel distance, wherein the first flow rate is greater than the second flow rate; and a check valve adapted to prevent fluid from flowing from the chamber through the first fluid passageway when the piston is moving from the first position to the second position.

18. The system of claim 17, wherein the piston blocks the second fluid passageway after the piston moves through the first travel distance to thereby prevent fluid from flowing from the chamber through the second fluid passageway.

19. The system of claim 17, wherein the second fluid passageway is configured to allow a greater flow of fluid than the third fluid passageway.

20. The system of claim 17, wherein the check valve includes a ball operatively engageable with a first seat and a second seat and wherein engagement of the ball with the first seat prevents a flow of fluid through the first fluid passageway.

21. The system of claim 20, wherein the second seat of the check valve has at least one passageway adapted to allow fluid to flow from the first fluid passageway to the chamber when the ball is engaged with the second seat.

22. The system of claim 17, wherein fluid flows from the opening to the chamber through each of the first, second, and third fluid passageways when the piston moves from the second position towards the first position.

* * * * *